US012434880B1

(12) United States Patent
Zhang

(10) Patent No.: US 12,434,880 B1
(45) Date of Patent: Oct. 7, 2025

(54) STORAGE BOX

(71) Applicant: Du Zhang, Taizhou (CN)

(72) Inventor: Du Zhang, Taizhou (CN)

( * ) Notice: Subject to any disclaimer, the term of this patent is extended or adjusted under 35 U.S.C. 154(b) by 0 days.

(21) Appl. No.: 19/051,455

(22) Filed: Feb. 12, 2025

(51) Int. Cl.
*B65D 6/16* (2006.01)
*B65D 6/34* (2006.01)
*B65D 43/16* (2006.01)

(52) U.S. Cl.
CPC ..... *B65D 11/18* (2013.01); *B65D 11/26* (2013.01); *B65D 43/166* (2013.01)

(58) Field of Classification Search
CPC .... B65D 11/186; B65D 5/0015; B65D 11/18; B65D 11/26; B65D 43/166; B65D 19/42; B65D 2519/00865; B65D 2519/00875; B65D 2519/0092; B65D 1/225; B65D 5/3678
See application file for complete search history.

(56) References Cited

U.S. PATENT DOCUMENTS 4,120,417 A * 10/1978 Aquino ..... B65D 7/18 220/9.4
4,618,068 A * 10/1986 Born ..... B65D 88/528 220/4.28
5,253,763 A * 10/1993 Kirkley ..... B65D 19/16 217/15
7,198,166 B2 * 4/2007 Sholinder ..... B65F 1/16 220/908
7,708,160 B2 * 5/2010 Booth ..... B65D 25/20 220/666
12,221,183 B2 * 2/2025 Repp ..... B62D 63/062
2004/0222222 A1 * 11/2004 Parnall ..... B65D 11/1833 220/6
2010/0059951 A1 * 3/2010 Hadar ..... B65G 1/07 108/57.33
2019/0270545 A1 * 9/2019 Apps ..... B65D 21/086
2021/0261295 A1 * 8/2021 Song ..... B65D 11/26

* cited by examiner

*Primary Examiner* — Kareen K Thomas
(74) *Attorney, Agent, or Firm* — Cooper Legal Group, LLC

(57) ABSTRACT

The invention discloses a storage box, relating to the technical field of storage boxes. Four side plates are arranged on front, rear, left and right edges of a bottom plate. Side edges of every two adjacent side plates are hinged with each other. The side plates on left and right sides are capable of being folded or unfolded front and rear to drive the side plates on front and rear sides close to or away from each other. A rear side of the bottom plate is hinged to the side plate on the rear side. The bottom plate is flippable up and down. A bottom of the reinforcing ring forms an insertion slot, and tops of the side plates are insertable into the insertion slot, so that the reinforcing ring limits the side plates from being folded. The invention has better firmness and stability.

15 Claims, 14 Drawing Sheets

STORAGE BOX

TECHNICAL FIELD

The invention relates to the technical field of storage boxes, and in particular to a storage box.

BACKGROUND

The existing storage box is foldable front and rear because the side plates on the left and right sides are each formed by two folding plates hinged with each other front and rear. When the two folding plates are folded or unfolded, the whole side plates on the left and right sides are folded or unfolded to drive the side plates on the front and rear sides close to or away from each other, so that the whole storage box is folded front and rear. One of the folding plates in this folding storage box is slidably provided with a pin. When the two folding plates are unfolded, one end of the pin is slidably inserted into the other folding plate, so that the pin connects the two folding plates, which can prevent the two folding plates from being folded. When the pin is slid to make it completely on one folding plate, the two folding plates can be folded. However, the pin has a small overall thickness and a small size, making it more likely to bend or break. If the side plates on the left and right sides are prevented from being folded only by the pin, the firmness of the storage box is greatly reduced.

SUMMARY

An objective of the invention is to provide a storage box to overcome the above defects so as to have better firmness and stability.

In order to achieve the above objective, the invention adopts the following solution:

A storage box includes a rectangular bottom plate, side plates, a reinforcing ring and a top lid. The four side plates are arranged on front, rear, left and right edges of the bottom plate, and side edges of every two adjacent side plates are hinged with each other, so that the four side plates and the bottom plate jointly form an accommodating chamber with a top opening; the side plates on left and right sides are capable of being folded front and rear or unfolded front and rear to form a vertical flat surface; the side plates on the left and right sides are folded to drive the side plates on front and rear sides close to each other, and unfolded to drive the side plates on the front and rear sides away from each other; a rear side of the bottom plate is hinged to the side plate on the rear side, so that the bottom plate is flippable up and down along hinges; the bottom plate is capable of opening a bottom of the accommodating chamber when being flipped up, and capable of blocking the bottom of the accommodating chamber and abutting against the side plate on the front side when being flipped down; when the bottom plate is flipped up and the side plates on the left and right sides drive the side plates on the front and rear sides close to each other, the storage box is in a folded state; when the side plates on the left and right sides are unfolded to drive the side plates on the front and rear sides away from each other and the bottom plate is flipped down to block the bottom of the accommodating chamber and abut against the side plate on the front side, the storage box is in an unfolded state, and in this case, the four side plates and the bottom plate jointly form the accommodating chamber with the top opening; a bottom of the annular hard reinforcing ring is recessed upward to form an insertion slot, and when the storage box is in the unfolded state, tops of the four side plates are insertable into the insertion slot, so that the reinforcing ring limits the side plates on the left and right sides from being folded front and rear; and the top lid covers a top of the reinforcing ring, thereby blocking the top opening of the accommodating chamber.

Further, the bottom plate is provided with a hand lifting portion, so that the bottom plate is flippable up by pulling the hand lifting portion.

Further, the hand lifting portion is a circular hole provided at a front side of the bottom plate, so that a human finger is extendable into the circular hole to pull the front side of the bottom plate up.

Further, the top lid is hinged to the reinforcing ring, and the top lid is flippable up along the hinges to open the top opening of the accommodating chamber or flippable down to cover the top opening of the accommodating chamber.

Further, the top lid is hinged to the reinforcing ring through connecting members, there are two connecting members hinged to an inner side wall of the reinforcing ring on a same side, one end of each of the connecting members is hinged to the reinforcing ring, and the other end forms a snap fit with the top lid.

Further, the side plates on the left and right sides each include two folding plates, the two folding plates are arranged front and rear, a rear side wall of the folding plate on the front side is hinged to a front side wall of the folding plate on the rear side, a rear side wall of the folding plate on the rear side is hinged to a side edge of the side plate on the rear side, a front side wall of the folding plate on the front side is hinged to a side edge of the side plate on the front side, and when the folding plates on the front and rear sides are swung and folded toward each other or swung and unfolded away from each other, the side plates on the left and right sides are folded or unfolded front and rear.

Further, the folding plate on the front side extends rearward to form first abutting portions, the folding plate on the rear side extends forward to form second abutting portions, and when the folding plates on the front and rear sides are unfolded to form the same vertical flat surface, the first abutting portions abut against a side wall of the folding plate on the rear side facing the accommodating chamber, and the second abutting portions abut against a side wall of the folding plate on the front side facing the accommodating chamber, so that the folding plates on the front and rear sides are only able to be swung and folded toward an inside of the accommodating chamber and the folding plates on the front and rear sides are only able to be swung toward an outside of the accommodating chamber to at most form the same vertical flat surface.

Further, the side plates on the left and right sides are provided with grooves, so that human hands are extendable into the grooves to lift the whole storage box.

Further, the side plate on the front side is provided with a door opening, the door opening is provided with a door, and the door is capable of opening or blocking the door opening.

Further, left and right sides of bottoms of the side plates on the front and rear sides are provided with swivel casters.

By adopting the above solution, the invention has the following beneficial effects:

In the invention, the storage box further includes the annular hard reinforcing ring, the bottom of the reinforcing ring is recessed upward to form the insertion slot, and when the storage box is in the unfolded state, the tops of the side plates on the left and right sides are also in the unfolded state, and in this case, the tops of the four side plates are all inserted into the insertion slot such that the reinforcing ring is utilized to limit the side plates on the left and right sides from being folded front and rear, thereby improving the firmness of the storage box in the unfolded state. Moreover, the tops of the four side plates are all inserted into the reinforcing ring, so that the reinforcing ring provides supporting power for the four side walls, which makes the storage box in the unfolded state more firm. In addition, when the storage box is in the unfolded state, the reinforcing ring makes the four side plates less likely to wobble in the insertion slot, which makes the accommodating chamber less likely to deform, thereby improving the stability.

DESCRIPTION OF EMBODIMENTS

The invention will be described in detail with reference to the accompanying drawings and specific embodiments.

Figure 1:
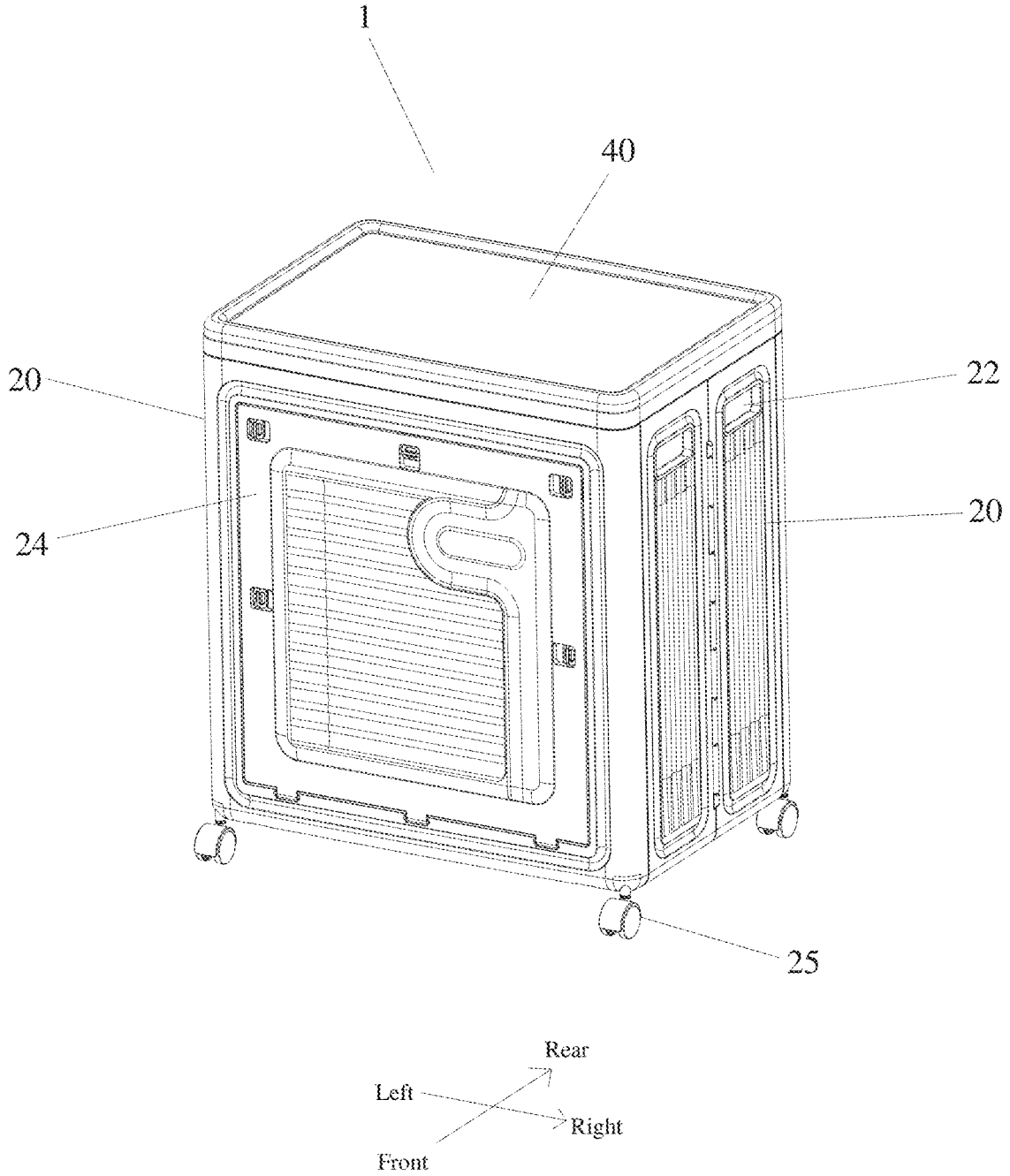
FIG. 1 is a schematic overall structural view of a storage box according to the invention.
Figure 2:
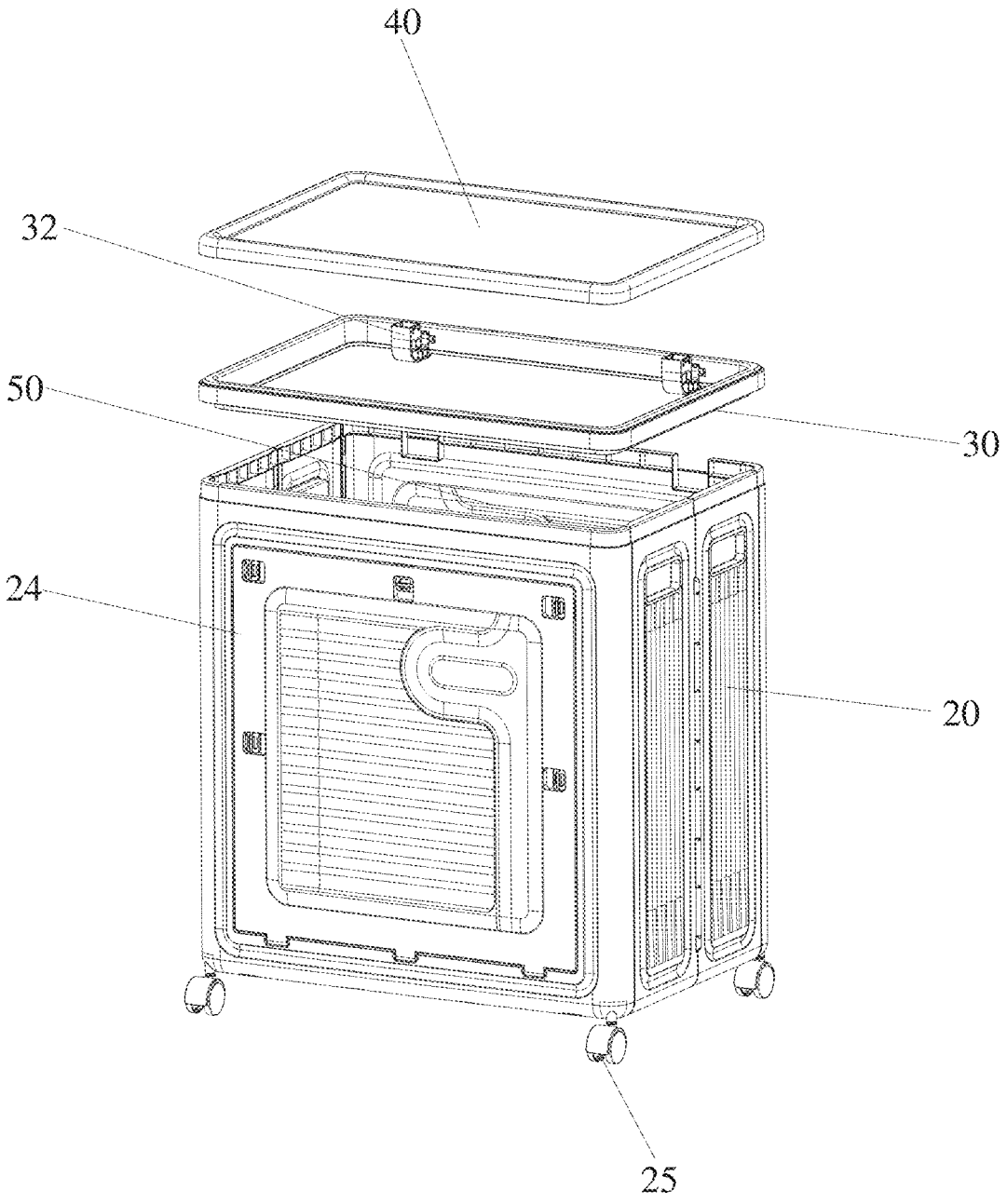
FIG. 2 is an exploded view of a top lid and a reinforcing ring of the storage box according to the invention.
Figure 3:
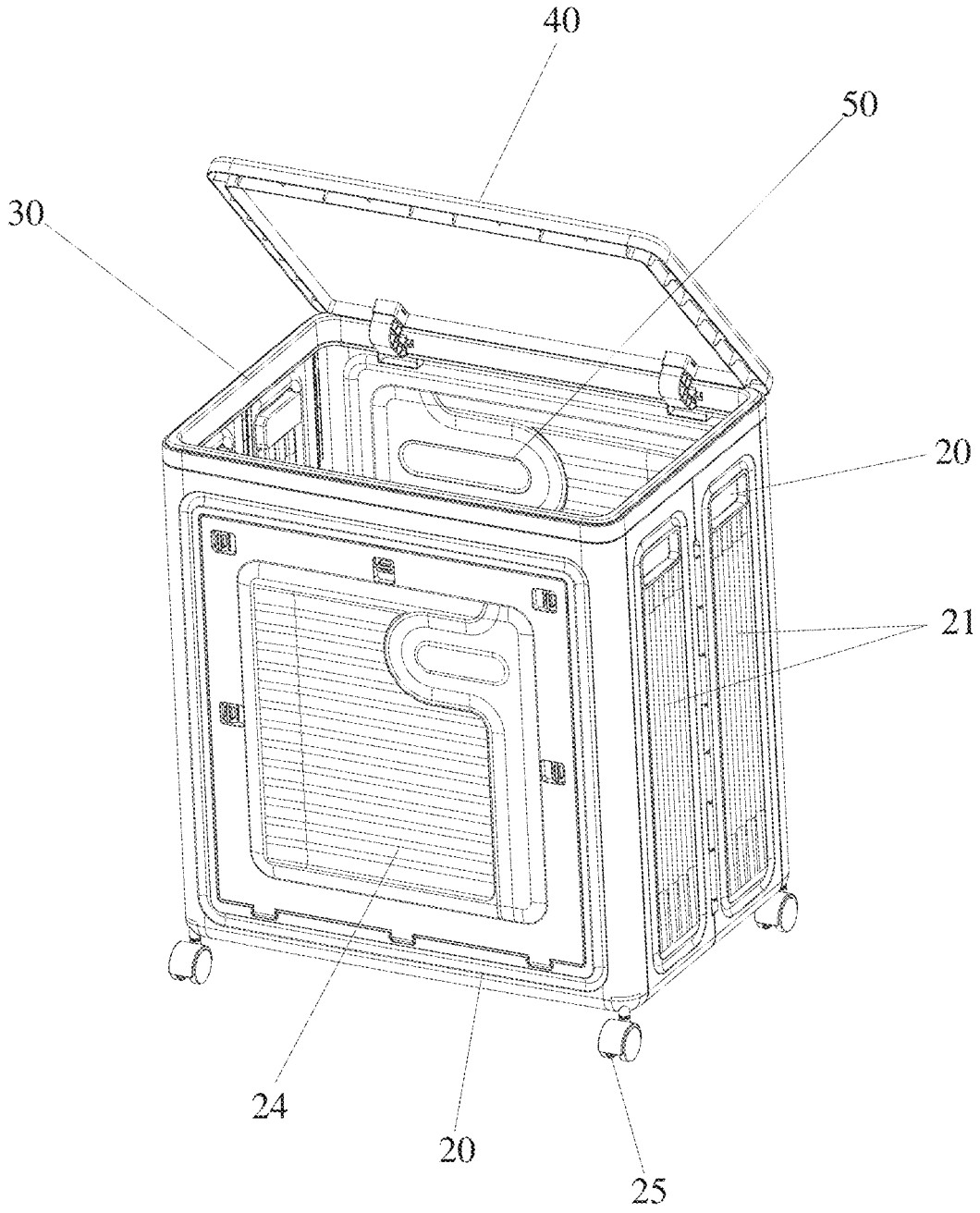
FIG. 3 is a schematic view of the storage box when the top lid is open according to the invention.
Figure 4:
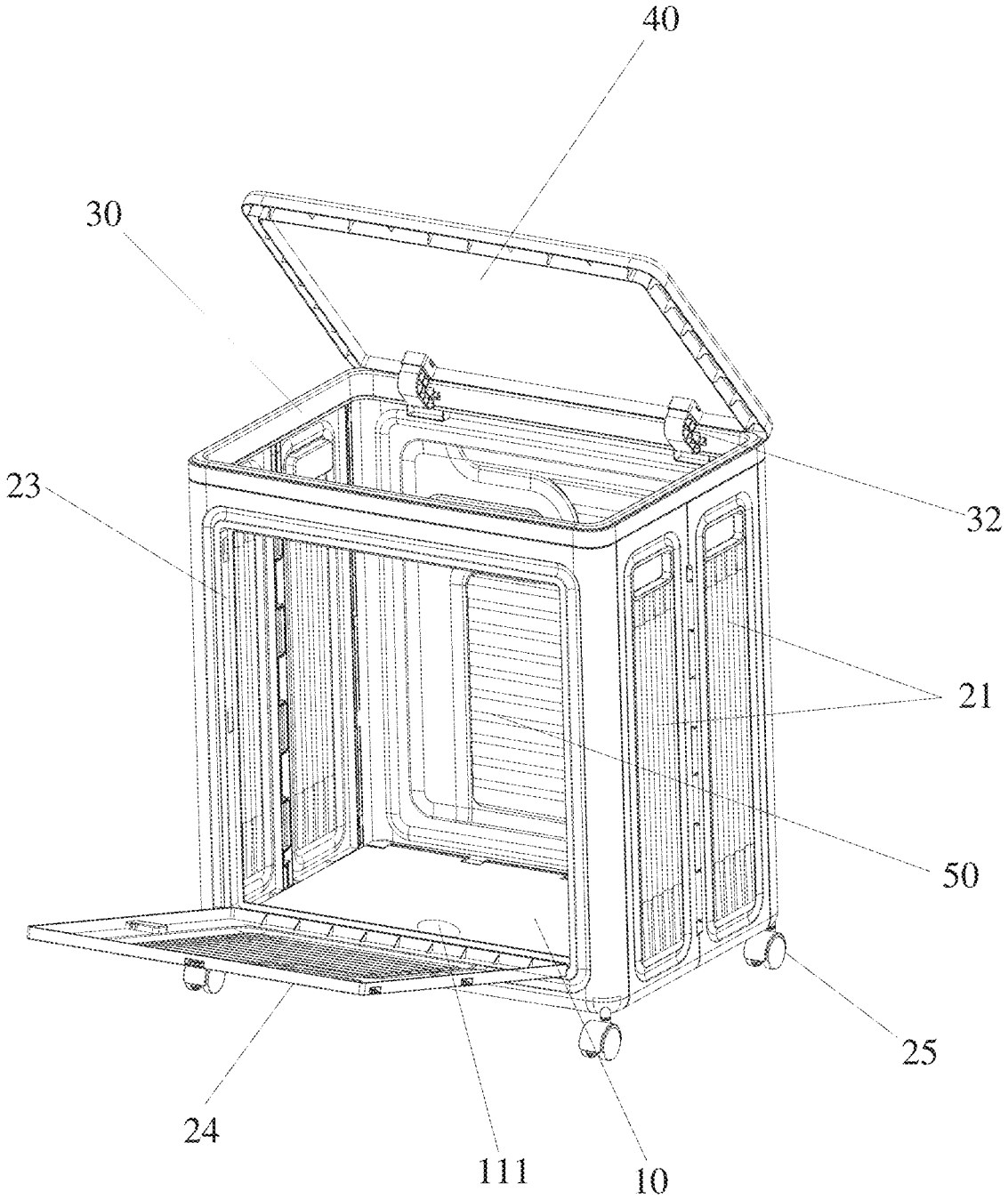
FIG. 4 is a schematic view of the storage box when the top lid and a door are open according to the invention.
Figure 5:
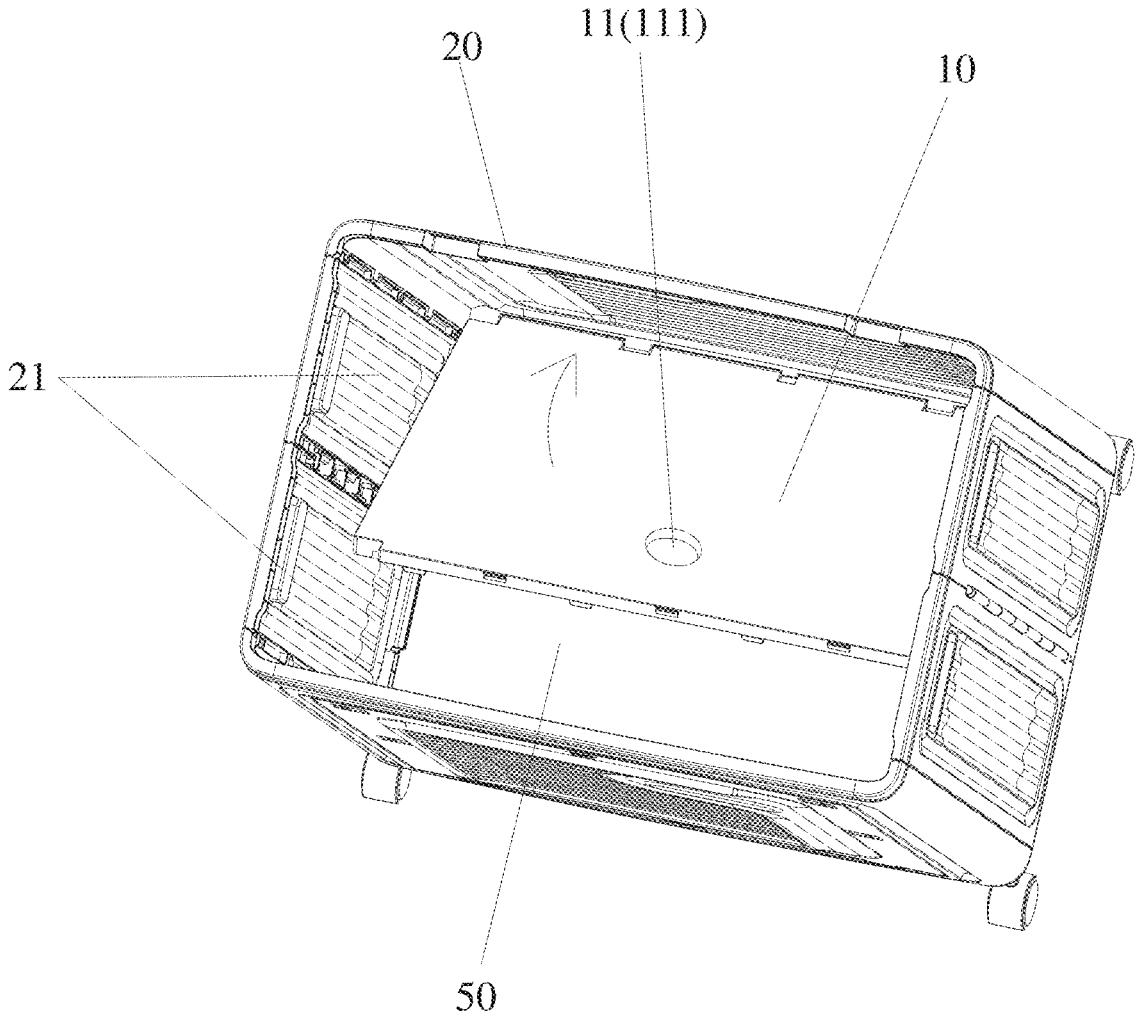
FIG. 5 is a view I showing a process of folding the storage box according to the invention.
Figure 6:
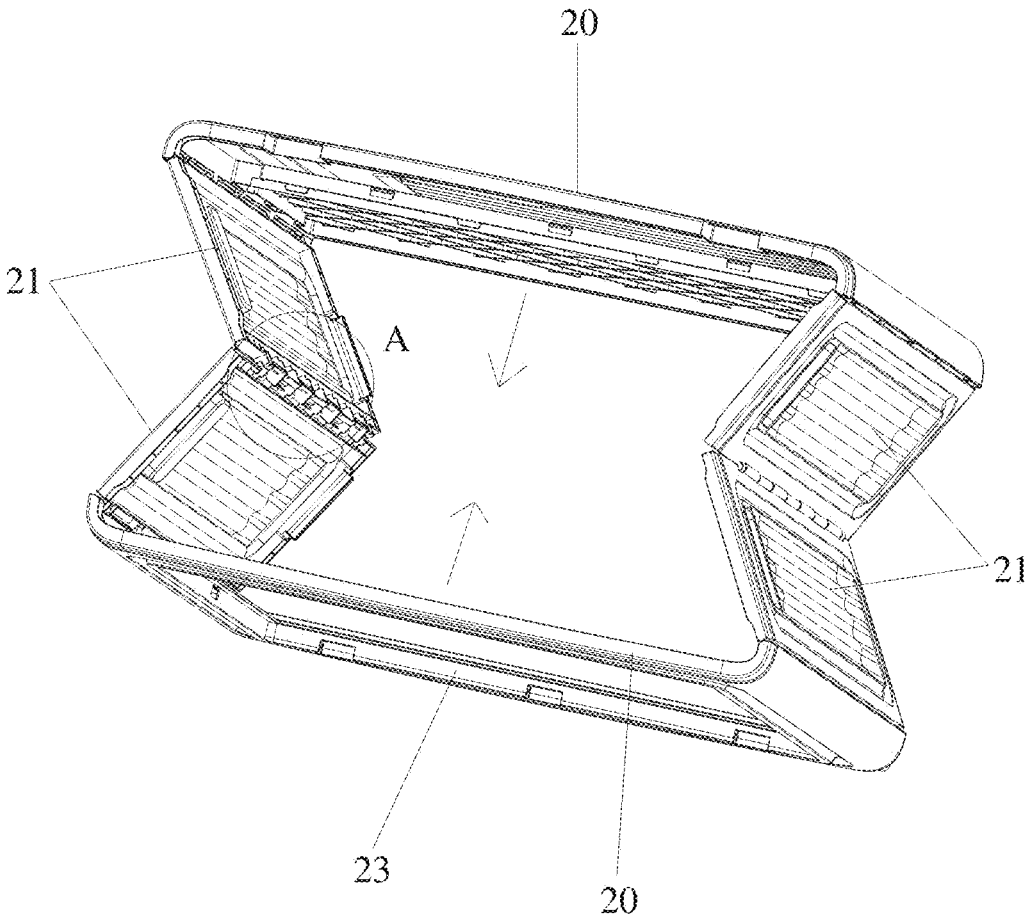
FIG. 6 is a view II showing the process of folding the storage box according to the invention.
Figure 7:
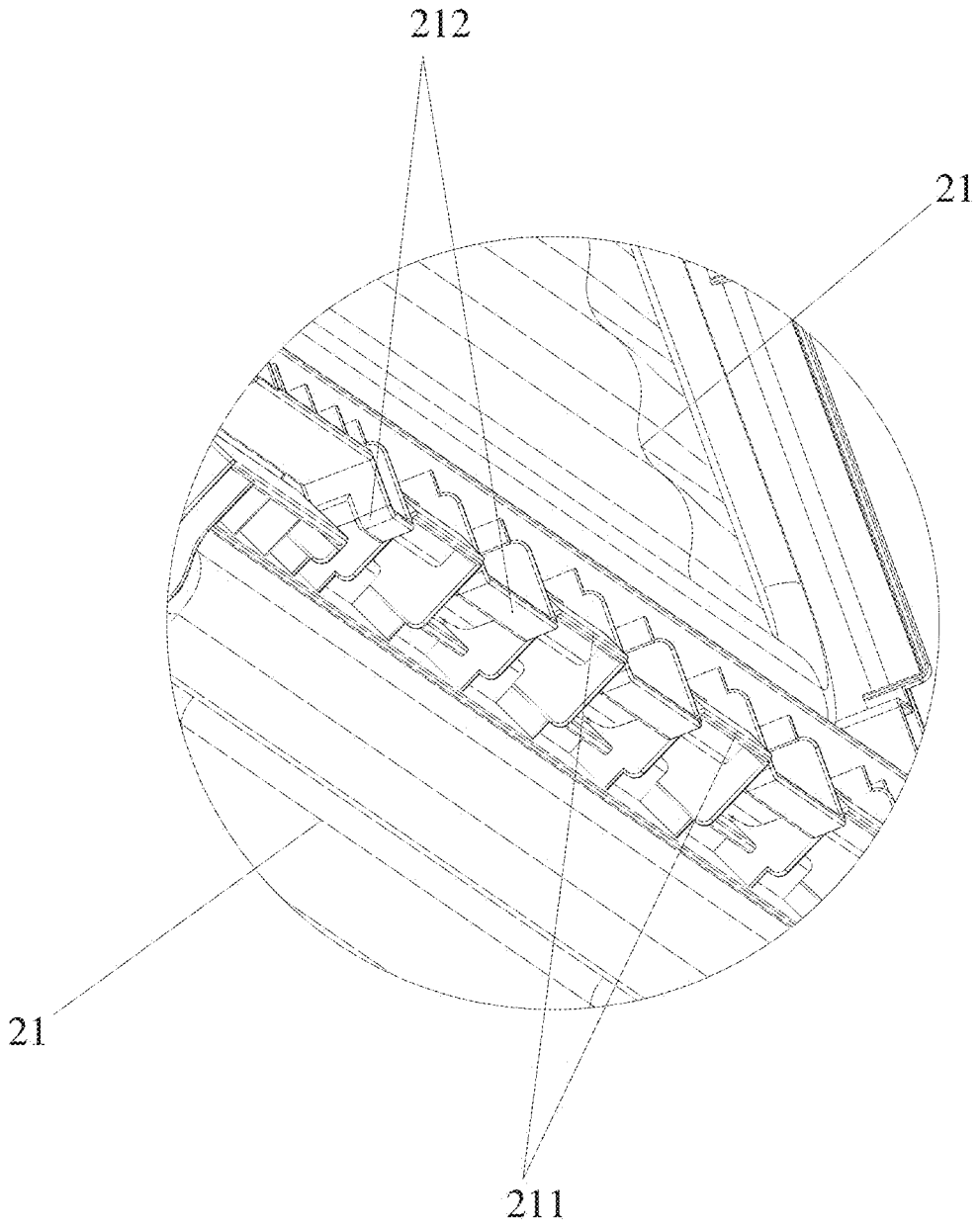
FIG. 7 is an enlarged view of A in FIG. 6.
Figure 8:
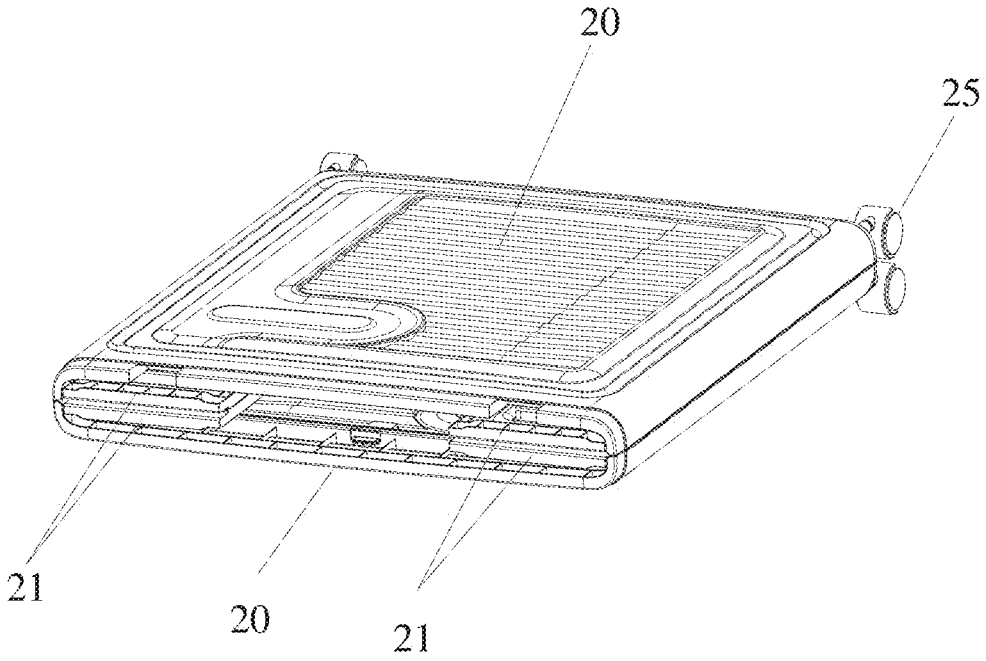
FIG. 8 is a view III showing the process of folding the storage box according to the invention.
Figure 9:
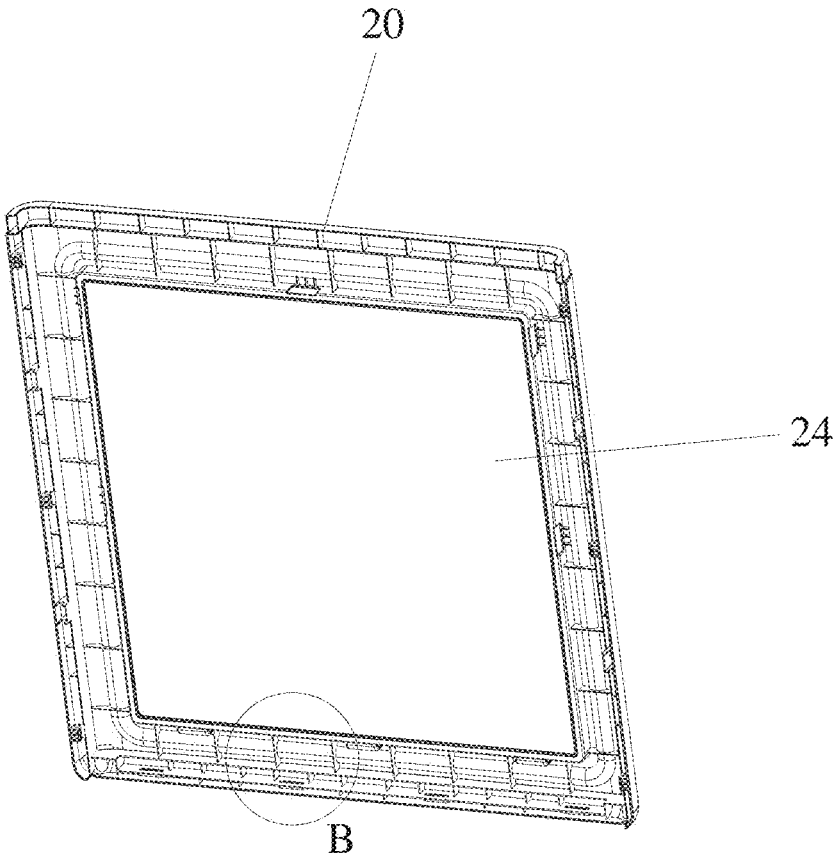
FIG. 9 is a schematic structural view of a side plate on a front side according to the invention.
Figure 10:
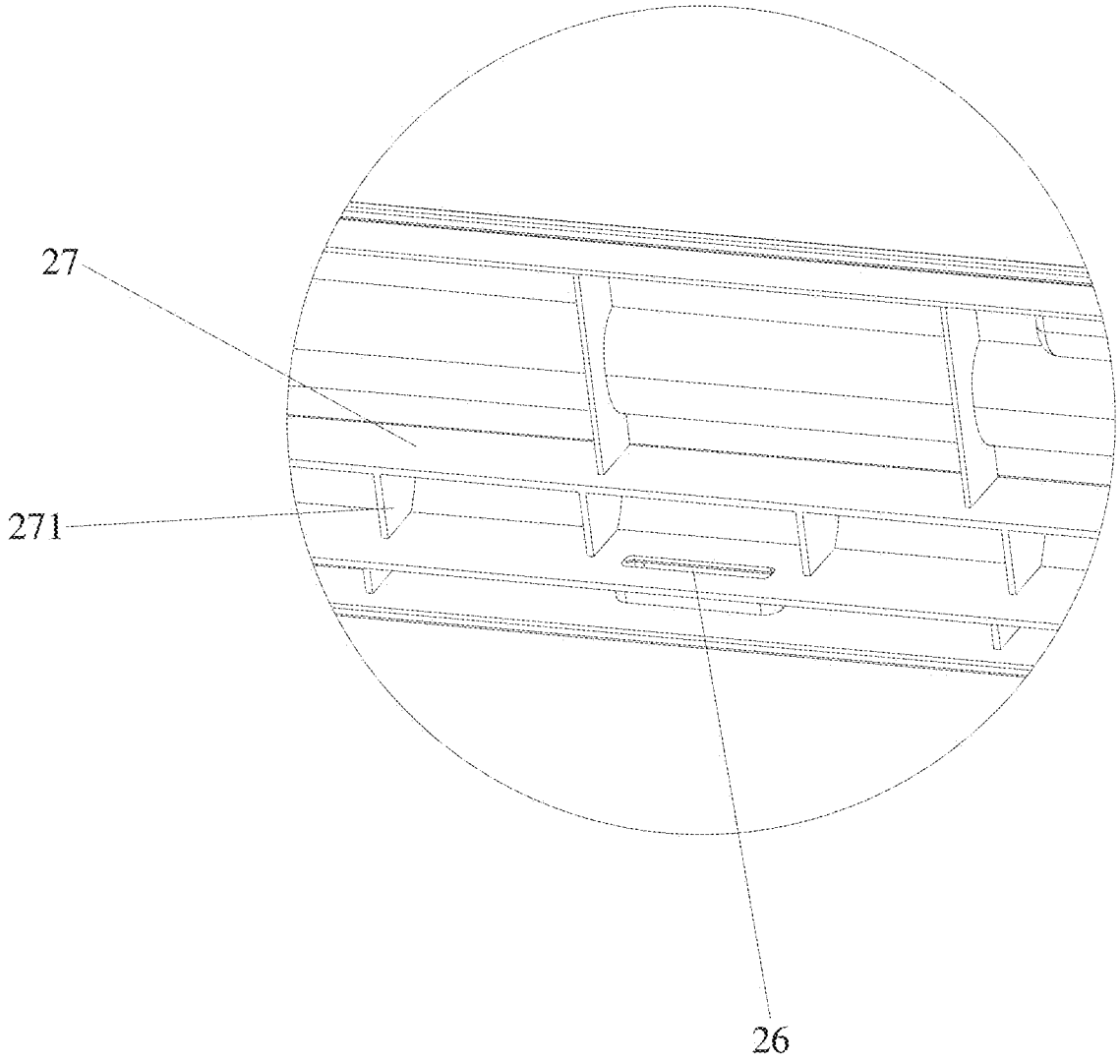
FIG. 10 is an enlarged view of B in FIG. 9.
Figure 11:
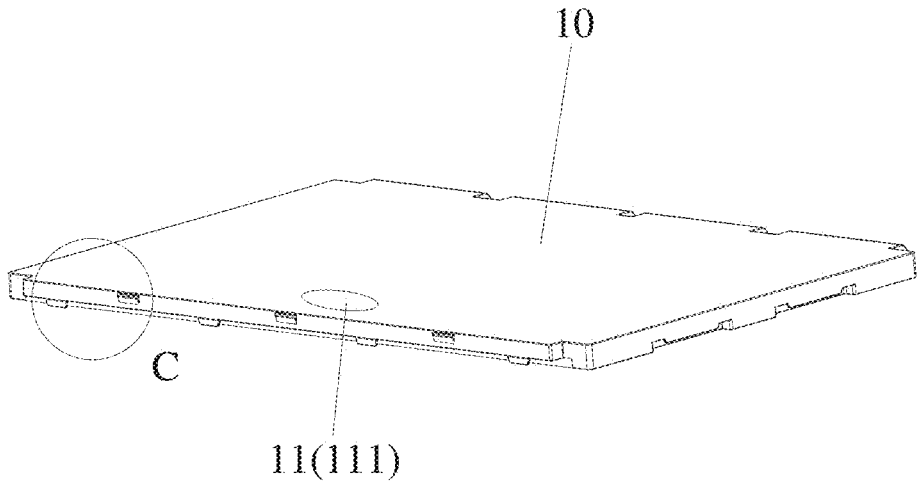
FIG. 11 is a schematic structural view of a bottom plate according to the invention.
Figure 12:
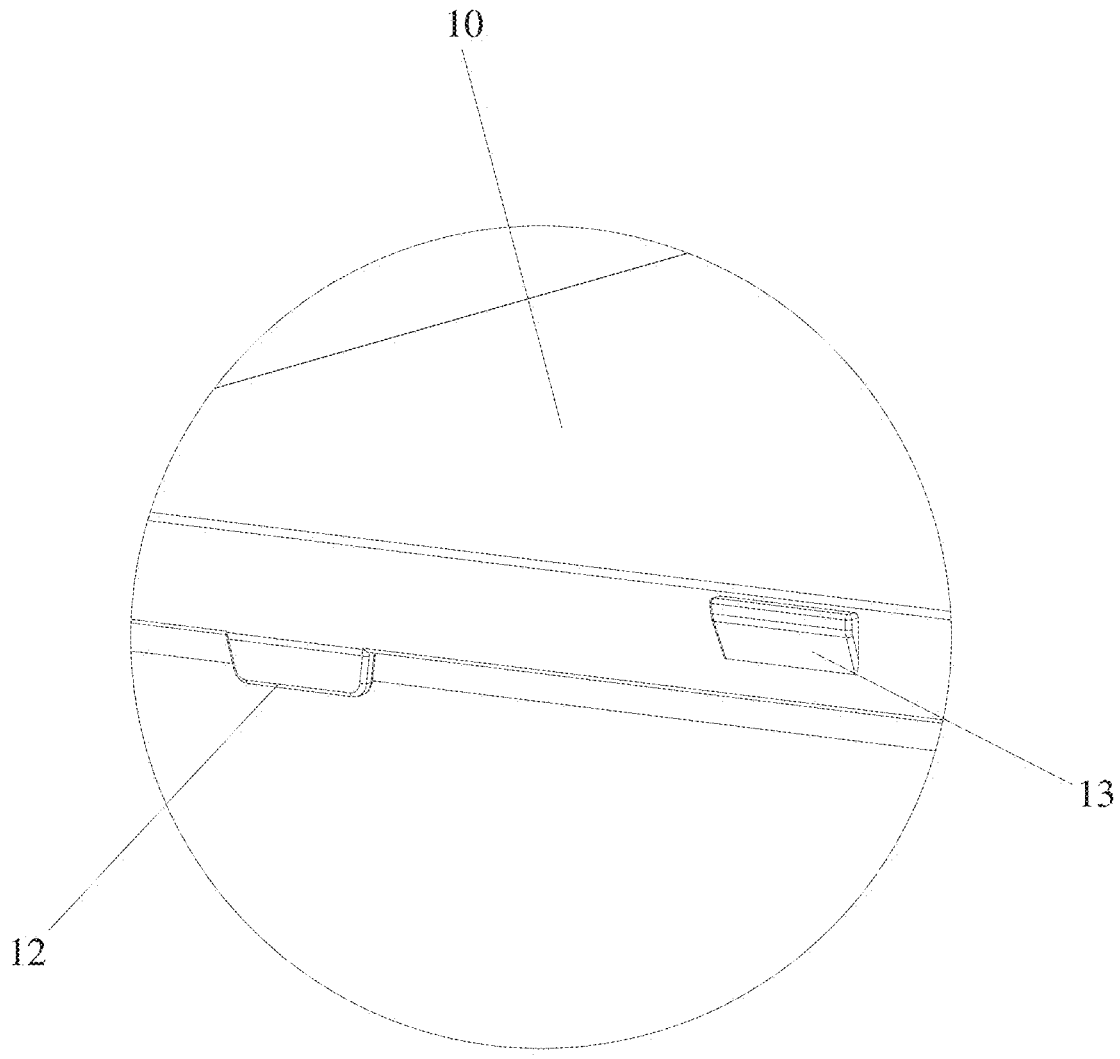
FIG. 12 is an enlarged view of C in FIG. 11.
Figure 13:
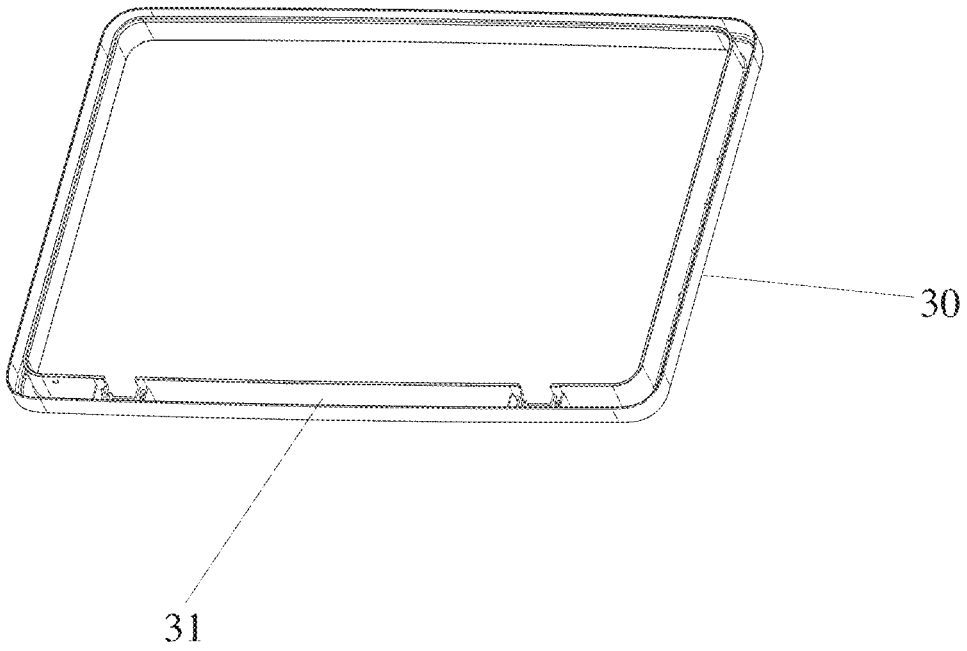
FIG. 13 is a schematic structural view of a bottom of a reinforcing ring according to the invention.
Figure 14:
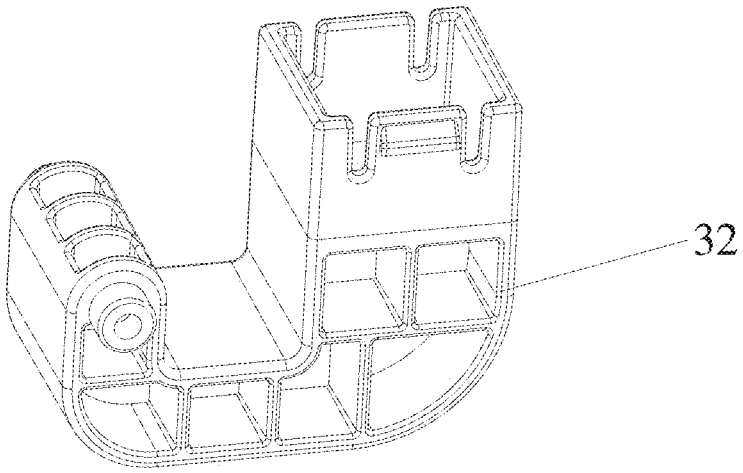
FIG. 14 is a schematic structural view of a connecting member according to the invention.

As shown in FIG. 1 to FIG. 14, the invention provides a storage box 1, including a rectangular bottom plate 10, a side plate 20, a reinforcing ring 30 and a top lid 40. The four side plates 20 are arranged on front, rear, left and right edges of the bottom plate 10, and side edges of every two adjacent side plates 20 are hinged with each other, so that the four side plates 20 and the bottom plate 10 jointly form an accommodating chamber 50 with a top opening. The side plates 20 on left and right sides are capable of being folded front and rear or unfolded front and rear to form a vertical flat surface. The side plates on the left and right sides are folded to drive the side plates 20 on front and rear sides close to each other, and unfolded to drive the side plates 20 on the front and rear sides away from each other. A rear side of the bottom plate 10 is hinged to the side plate 20 on the rear side, so that the bottom plate 10 is flippable up and down along hinges. The bottom plate is capable of opening a bottom of the accommodating chamber 50 when being flipped up, and capable of blocking the bottom of the accommodating chamber 50 and abutting against the side plate 20 on the front side when being flipped down; when the bottom plate 10 is flipped up and the side plates 20 on the left and right sides drive the side plates 20 on the front and rear sides close to each other, the storage box 1 is in a folded state. When the side plates 20 on the left and right sides are unfolded to drive the side plates 20 on the front and rear sides away from each other and the bottom plate 10 is flipped down to block the bottom of the accommodating chamber 50 and abut against the side plate 20 on the front side, the four side plates 20 and the bottom plate 10 jointly form the accommodating chamber 50 with the top opening, the storage box 1 is in an unfolded state, and in this case, the four side plates 20 and the bottom plate 10 jointly form the accommodating chamber 50 with the top opening; a bottom of the annular hard reinforcing ring 30 is recessed upward to form an insertion slot 31, and when the storage box 1 is in the unfolded state, tops of the four side plates 20 are insertable into the insertion slot 31, so that the reinforcing ring 30 limits the side plates 20 on the left and right sides from being folded front and rear. The top lid 40 covers a top of the reinforcing ring 30, thereby blocking the top opening of the accommodating chamber 50. Specifically, the rear side of the bottom plate 10 is hinged to a bottom of the side plate 20 on the rear side. Specifically, the reinforcing ring is made of a hard material, such as hard plastic.

In the invention, the storage box 1 further includes the annular hard reinforcing ring 30, the bottom of the reinforcing ring 30 is recessed upward to form the insertion slot 31, and when the storage box 1 is in the unfolded state, the tops of the side plates 20 on the left and right sides are also in the unfolded state, and in this case, the tops of the four side plates 20 are all inserted into the insertion slot 31 such that the reinforcing ring 30 is utilized to limit the side plates 20 on the left and right sides from being folded front and rear, thereby improving the firmness of the storage box 1 in the unfolded state. Moreover, the tops of the four side plates 20 are all inserted into the reinforcing ring 30, so that the reinforcing ring 30 provides supporting power for the four side walls, which makes the storage box 1 in the unfolded state more firm. In addition, when the storage box 1 is in the unfolded state, the top opening is more stable, and the reinforcing ring 30 makes the four side plates 20 less likely to wobble in the insertion slot 31, which makes the accommodating chamber 50 less likely to deform, thereby improving the stability.

Further, the bottom plate 10 is provided with a hand lifting portion 11, so that the bottom plate 10 is flippable up by pulling the hand lifting portion 11.

Preferably, the hand lifting portion 11 is a circular hole 111 provided at a front side of the bottom plate 10, so that a human finger is extendable into the circular hole 111 to pull the front side of the bottom plate 10 up, which facilitates folding of the storage box 1.

Further, the top lid 40 is hinged to the reinforcing ring 30, and the top lid 40 is flippable up along the hinges to open the top opening of the accommodating chamber 50 or flippable down to cover the top opening of the accommodating chamber 50.

Preferably, the top lid 40 is hinged to the reinforcing ring 30 through connecting members 32, there are two connecting members 32 hinged to an inner side wall of the reinforcing ring 30 on a same side, one end of each of the connecting members 32 is hinged to the reinforcing ring 30, and the other end forms a snap fit with the top lid 40. Specifically, the connecting member 32 is J-shaped. The end of the connecting member with a lower level is hinged to an inner side of the reinforcing ring 30, and the end with a higher level faces up and forms a snap fit with the bottom of the top lid 40. The higher end rotates around the lower end, so that the top lid 40 opens the top of the accommodating chamber 50 when being flipped up, or covers the top of the accommodating chamber 50 when being flipped down.

Preferably, the side plates 20 on the left and right sides each include two folding plates 21, the two folding plates 21 are arranged front and rear, a rear side wall of the folding plate 21 on the front side is hinged to a front side wall of the folding plate 21 on the rear side, a rear side wall of the folding plate 21 on the rear side is hinged to a side edge of the side plate 20 on the rear side, a front side wall of the folding plate 21 on the front side is hinged to a side edge of the side plate 20 on the front side, and when the folding plates 21 on the front and rear sides are swung and folded toward each other or swung and unfolded away from each other, the side plates 20 on the left and right sides are folded or unfolded front and rear.

Specifically, the folding plate 21 on the front side extends rearward to form first abutting portions 211, the folding plate 21 on the rear side extends forward to form second abutting portions 212, and when the folding plates 21 on the front and rear sides are unfolded to form the same vertical flat surface, the first abutting portions 211 abut against a side wall of the folding plate 21 on the rear side facing the accommodating chamber 50, and the second abutting portions 212 abut against a side wall of the folding plate 21 on the front side facing the accommodating chamber 50, so that the folding plates 21 on the front and rear sides are only able to be swung and folded toward an inside of the accommodating chamber 50 and the folding plates 21 on the front and rear sides are only able to be swung toward an outside of the accommodating chamber 50 to at most form the same vertical flat surface. The folding plates 21 on the front and rear sides can only be swung and folded toward the inside of the accommodating chamber 50, and after being folded, the side plates 20 on the front and rear sides respectively cover the folding plates 21 on the front and rear sides, so that the size of the folded storage box 1 is reduced, which can reduce the occupied space during transportation, thereby reducing the transportation cost. Specifically, the first abutting portions 211 and the second abutting portions 212 may be staggered. It can be understood that the specific structures and shapes of the first abutting portions 211 and the second abutting portions 212 are not limited as long as the above functions can be met. The first abutting portions 211 and the second abutting portions 212 may be plate-like structures.

Further, the side plates 20 on the left and right sides are provided with grooves 22, so that human hands are extendable into the grooves 22 to lift the whole storage box 1. Specifically, each folding plate 21 is provided with one groove 22, so that the storage box 1 can be lifted with both hands.

Further, the side plate 20 on the front side is provided with a door opening 23, the door opening 23 is provided with a door 24, and the door 24 is capable of opening or blocking the door opening 23. Specifically, a bottom of the door 24 is hinged to a bottom edge of the door opening 23, so that the door 24 is flippable up along the hinges to block the door opening 23 or flippable down to open the door opening 23. Edges of the door 24 are provided with snap-fit protrusions, and edges of the door opening 23 except the bottom edge are provided with snap-fit grooves. When the door 24 blocks the door opening 23, the snap-fit protrusions may be pushed to be inserted into the snap-fit grooves, so that the door 24 and the door opening 23 form a snap fit, which prevents the door 24 from falling down and opening the door opening 23. It can be understood that the specific structure of the snap-fit protrusions is not limited as long as the function can be implemented.

Further, left and right sides of bottoms of the side plates 20 on the front and rear sides are provided with swivel casters 25, so that the storage box 1 can be pushed conveniently.

As shown in FIG. 9 to FIG. 12, the bottom of the side plate 20 on the front side horizontally protrudes rearward to form a snap-fit platform 27, the front side of the bottom plate 10 protrudes forward to form a plurality of wedge-shaped protrusions 13, a top surface of the protrusion 13 is a horizontal forward flat surface, and a front side surface of the protrusion 13 is a wedge surface inclined rearward. In the process of the bottom plate 10 being flipped down to a horizontal state, the front side surface of the protrusion 13 gradually comes into contact with the snap-fit platform 27, which stops the bottom plate 10 from being further flipped down. Since the whole storage box 1 is made of plastic, the snap-fit platform 27 is slightly deformed under the action of an external force to give way to the protrusion 13, so that the protrusion 13 passes through the snap-fit platform 27 and the snap-fit platform 27 abuts against the top surface of the protrusion 13, which stops the protrusion 13 from moving up and further stops the bottom plate 10 from moving up. Therefore, when the bottom plate 10 needs to be flipped up, the user needs to push the side plate 20 on the front side forward to make the snap-fit platform 27 deformed outward and give way to the protrusion 13, so that the protrusion 13 passes through the snap-fit platform 27, and further, the bottom plate 10 is further flipped up. Further, a bottom of the snap-fit platform 27 is provided with a plurality of vertical ribs 271 that are arranged left and right at intervals to improve the firmness of the snap-fit platform 27. Further, the vertical ribs directly abut against a front end of the bottom plate 10, so that the bottom plate 10 can abut against the side plate 20 on the front side when in the unfolded state.

Specifically, the front side of the bottom plate 10 protrudes downward to form snap-fit plates 12, a bottom edge of the side plate 20 on the front side extends rearward horizontally through an arc transition, the arc transition is provided with corresponding slots 26, and the snap-fit plates 12 can be inserted into the slots 26 to limit the bottom plate 10 from wobbling.

To further illustrate the embodiments, the accompanying drawings are provided in the invention. These accompanying drawings are a part of the contents disclosed in the invention that are mainly used to illustrate the embodiments, and can be used in conjunction with the related descriptions in the specification to explain the operation principle of the embodiments. With reference to these contents, those of ordinary skill in the art should be able to understand other possible implementations and advantages of the invention. Components in the drawings are not drawn to scale, and like component symbols are usually used to represent like components.

Moreover, the orientations such as front, rear, left and right in this embodiment are only used as a reference for orientations, and do not represent the orientations in actual application. In addition, the terms "first", "second" and "third" are only used for descriptive purposes, and cannot be understood as indicating or implying relative importance.

The above is merely preferred embodiments of the invention, and is not a limitation to the design of the invention. All equivalent changes made according to the design keys of the invention shall fall within the protection scope of the invention.

The invention claimed is:

1. A storage box, comprising: a rectangular bottom plate, four side plates, a reinforcing ring and a top lid; wherein the four side plates are arranged on a front edge, a rear edge, a left edge and a right edge of the rectangular bottom plate, and side edges of every two adjacent side plates of the four side plates are hinged with each other, so that the four side plates and the rectangular bottom plate jointly form an accommodating chamber with a top opening; a side plate of the four side plates on the left edge and a side plate of the four side plates on the right edge are configured to be folded front and rear or unfolded front and rear to form a vertical flat surface; the side plate on the left edge and the side plate on the right edge are folded to drive a side plate of the four side plates on the front edge and a side plate of the four side plates on the rear edge close to each other, and unfolded to drive the side plate on the front edge and the side plate on the rear edge away from each other; a rear side of the rectangular bottom plate is hinged to the side plate on the rear edge, so that the rectangular bottom plate is flippable up and down along a plurality of hinges; the rectangular bottom plate is configured to open a bottom of the accommodating chamber when flipped up and configured to block the bottom of the accommodating chamber and abut against the side plate on the front edge when flipped down; when the rectangular bottom plate is flipped up and the side plate on the left edge and the side plate on the right edge drive the side plate on the front edge and the side plate on the rear edge close to each other, the storage box is in a folded state; when the side plate on the left edge and the side plate on the right edge are unfolded to drive the side plate on the front edge and the side plate on the rear edge away from each other and the rectangular bottom plate is flipped down to block the bottom of the accommodating chamber and abut against the side plate on the front edge, the storage box is in an unfolded state, and when the storage box is in the unfolded state, the four side plates and the rectangular bottom plate jointly form the accommodating chamber with the top opening;

a bottom of the reinforcing ring is recessed upwards to form an insertion slot, and when the storage box is in the unfolded state, tops of the four side plates are insertable into the insertion slot, so that the reinforcing ring limits the side plate on the left edge and the side plate on the right edge from being folded front and rear; and the top lid covers a top of the reinforcing ring, thereby blocking the top opening of the accommodating chamber.

2. The storage box according to claim 1, wherein the rectangular bottom plate is provided with a hand lifting portion, so that the rectangular bottom plate is configured to be flipped up by pulling the hand lifting portion.

3. The storage box according to claim 2, wherein the hand lifting portion is a circular hole provided at a front side of the rectangular bottom plate, so that a human finger is extendable into the circular hole to pull the front side of the rectangular bottom plate up.

4. The storage box according to claim 1, wherein the top lid is hinged to the reinforcing ring, and the top lid is configured to be flipped up along the plurality of hinges to open the top opening of the accommodating chamber or configured to be flipped down to cover the top opening of the accommodating chamber.

5. The storage box according to claim 4, wherein the top lid is hinged to the reinforcing ring through two connecting members hinged to an inner side wall of the reinforcing ring on a same side of the inner side wall of the reinforcing ring, one end of each of the two connecting members is hinged to the reinforcing ring, and a second end of each of the two connecting members forms a snap fit with the top lid.

6. The storage box according to claim 1, wherein the side plate on the left edge and the side plate on the right edge each comprises two folding plates, the two folding plates are arranged front side and rear side, a rear side wall of a folding plate of the two folding plates on the front side is hinged to a front side wall of a folding plate of the two folding plates on the rear side, a rear side wall of the folding plate on the rear side is hinged to a side edge of the side plate on the rear edge, a front side wall of the folding plate on the front side is hinged to a side edge of the side plate on the front edge, and when the two folding plates on the front side and the rear side are swung and folded toward each other or swung and unfolded away from each other, the side plate on the left edge and the side plate on the right edge are folded or unfolded front and rear.

7. The storage box according to claim 6, wherein the folding plate on the front side extends rearward to form first abutting portions, the folding plate on the rear side extends forward to form second abutting portions, and when the two folding plates on the front side and the rear side are unfolded to form the vertical flat surface, the first abutting portions abut against a side wall of the folding plate on the rear side facing the accommodating chamber, and the second abutting portions abut against a side wall of the folding plate on the front side facing the accommodating chamber, so that the two folding plates on the front side and the rear side are able to be swung and folded toward an inside of the accommodating chamber and the two folding plates on the front side and the rear side are only able to be swung toward an outside of the accommodating chamber to at most form the vertical flat surface.

8. The storage box according to claim 1, wherein the side plate on the left edge and the side plate on the right edge are provided with grooves, so that human hands are extendable into the grooves to lift the storage box.

9. The storage box according to claim 1, wherein the side plate on the front edge is provided with a door opening, the door opening is provided with a door, and the door is configured to open or block the door opening.

10. The storage box according to claim 1, wherein left and right sides of bottoms of the side plate on the front edge and the side plate on the rear edge are provided with swivel casters.

11. The storage box according to claim 5, wherein each of the two connecting members is J-shaped, one end of each of the two connecting members with a lower level is hinged to an inner side of the reinforcing ring, and another end with a higher level faces up and forms a snap fit with a bottom of the top lid.

12. The storage box according to claim 9, wherein a bottom of the door is hinged to a bottom edge of the door opening, so that the door is flippable up to block the door opening or flippable down to open the door opening.

13. The storage box according to claim 1, wherein a bottom of the side plate on the front edge horizontally protrudes rearward to form a snap-fit platform, a front edge of the rectangular bottom plate protrudes forward to form a plurality of wedge-shaped protrusions, a top surface of each of the plurality of wedge-shaped protrusions is a horizontal forward flat surface, and a front side surface of each of the plurality of wedge-shaped protrusions is a wedge surface inclined rearward, such that when the rectangular bottom plate is flipped down to a horizontal state, the front side surface of each of the plurality of wedge-shaped protrusions gradually comes into contact with the snap-fit platform, thereby stopping the rectangular bottom plate from being flipped down.

14. The storage box according to claim 13, wherein a bottom of the snap-fit platform is provided with a plurality of vertical ribs that are arranged left and right at intervals.

15. The storage box according to claim 14, wherein the plurality of vertical ribs directly abut against the front edge of the rectangular bottom plate.

* * * * *